US008662137B2

(12) United States Patent
Bohlen

(10) Patent No.: US 8,662,137 B2
(45) Date of Patent: Mar. 4, 2014

(54) ATTACHMENT OF AN ARCHITECTURAL COVERING

(75) Inventor: Jörg Bohlen, Langen (DE)

(73) Assignee: Hunter Douglas Industries BV, Rotterdam (NL)

( * ) Notice: Subject to any disclaimer, the term of this patent is extended or adjusted under 35 U.S.C. 154(b) by 709 days.

(21) Appl. No.: 12/139,013

(22) Filed: Jun. 13, 2008

(65) Prior Publication Data

US 2008/0245490 A1 Oct. 9, 2008

Related U.S. Application Data

(62) Division of application No. 10/931,561, filed on Aug. 31, 2004, now Pat. No. 7,438,115.

(30) Foreign Application Priority Data

Sep. 8, 2003 (EP) ..... 03077819

(51) Int. Cl.
*A47H 1/00* (2006.01)

(52) U.S. Cl.
USPC ..... 160/241; 160/121.1; 38/102.91

(58) Field of Classification Search
USPC ..... 160/85, 86, 126, 382, 392, 395, 398, 160/121.1, 120, 241, 383; 242/587
See application file for complete search history.

(56) References Cited

U.S. PATENT DOCUMENTS

| | | | | | |
|---|---|---|---|---|---|
| 81,002 | A | * | 8/1868 | Preston | 384/267 |
| 1,553,862 | A | * | 9/1925 | Kirsch | 160/398 |
| 2,029,675 | A | | 2/1936 | Schlamp | |
| 2,208,213 | A | * | 7/1940 | Ericson | 281/33 |
| 2,311,326 | A | * | 2/1943 | Birkin | 160/395 |
| 2,832,171 | A | * | 4/1958 | Batey | 38/102.91 |
| 3,036,354 | A | * | 5/1962 | De Bie | 24/462 |
| 3,701,376 | A | * | 10/1972 | Froget | 160/121.1 |
| 3,724,524 | A | * | 4/1973 | Potter | 160/24 |
| 3,789,904 | A | * | 2/1974 | Takazawa | 160/120 |
| 3,922,804 | A | * | 12/1975 | Batey | 38/102.91 |
| 4,033,397 | A | * | 7/1977 | McKee | 160/393 |
| 4,151,665 | A | * | 5/1979 | Gibby | 38/102.91 |
| 4,344,474 | A | * | 8/1982 | Berman | 160/121.1 |
| 4,562,634 | A | * | 1/1986 | Watts | 29/407.1 |
| 4,631,786 | A | * | 12/1986 | Curry | 24/460 |
| 4,711,469 | A | * | 12/1987 | Bogar | 281/27.2 |
| 5,033,529 | A | * | 7/1991 | Koschade | 160/398 |
| 5,133,140 | A | * | 7/1992 | Frey | 38/102.91 |
| 5,335,246 | A | | 8/1994 | Yokev et al. | |
| 5,347,732 | A | * | 9/1994 | Padawer | 38/102.4 |
| 5,566,736 | A | * | 10/1996 | Crider et al. | 160/121.1 |

(Continued)

FOREIGN PATENT DOCUMENTS

| | | |
|---|---|---|
| DE | 23 26 438 | 2/1975 |
| DE | 25 19 365 | 11/1976 |

(Continued)

*Primary Examiner* — Katherine Mitchell
*Assistant Examiner* — Candace L Bradford
(74) *Attorney, Agent, or Firm* — Dorsey & Whitney LLP

(57) ABSTRACT

A system for attaching a shade material to a roller having recesses in its surface includes inserting portions of the shade material into an associated elongated recess and retaining the material in the recess with an attachment member having peaks and valleys along its length for intermittent engagement with the material within the recess.

15 Claims, 7 Drawing Sheets

(56) References Cited

U.S. PATENT DOCUMENTS

| | | | | |
|---|---|---|---|---|
| 5,601,129 | A * | 2/1997 | Colson et al. | 160/121.1 |
| 5,647,176 | A * | 7/1997 | Milliken et al. | 52/63 |
| 5,809,059 | A | 9/1998 | Souissi et al. | |
| 5,855,235 | A * | 1/1999 | Colson et al. | 160/121.1 |
| D412,753 | S * | 8/1999 | Colson et al. | D25/48.4 |
| 6,189,592 | B1 * | 2/2001 | Domel | 160/85 |
| 6,237,667 | B1 * | 5/2001 | Fraczek et al. | 160/121.1 |
| 6,643,278 | B1 | 11/2003 | Panasik et al. | |
| 6,672,361 | B2 * | 1/2004 | Fransen | 160/85 |
| 7,063,124 | B2 * | 6/2006 | Walker et al. | 160/392 |
| 7,806,160 | B2 * | 10/2010 | Byeon | 160/85 |
| 2004/0121827 | A1 | 6/2004 | Murakami et al. | |
| 2005/0167058 | A1 * | 8/2005 | Walker et al. | 160/395 |
| 2006/0021713 | A1 * | 2/2006 | Hsu | 160/85 |
| 2007/0084568 | A1 * | 4/2007 | Nien | 160/85 |
| 2008/0245490 | A1 * | 10/2008 | Bohlen | 160/241 |
| 2009/0173454 | A1 * | 7/2009 | Cheng | 160/120 |

FOREIGN PATENT DOCUMENTS

| | | | | |
|---|---|---|---|---|
| EP | 0081002 | B1 | 6/1983 | |
| EP | 1 088 920 | A2 | 4/2001 | |
| EP | 1 241 318 | A2 | 9/2002 | |
| FR | 1 366 224 | | 7/1974 | |
| GB | 19 449 | | 1/1909 | |
| GB | 926 663 | | 5/1963 | |
| GB | 1 227 619 | | 4/1971 | |
| GB | 2 279 686 | A | 1/1995 | |
| GB | 2326438 | A * | 12/1998 | F16L 33/08 |
| NL | 7209084 | | 1/1974 | |
| WO | WO 92/19873 | A1 | 11/1992 | |

* cited by examiner

ATTACHMENT OF AN ARCHITECTURAL COVERING

CROSS REFERENCE TO RELATED APPLICATIONS

The present application is a divisional of co-pending U.S. application Ser. No. 10/931,561, filed Aug. 31, 2004, which claims priority to European patent application No. 03077819.5, filed Sep. 8, 2003, which are both hereby incorporated by reference as if fully disclosed herein.

BACKGROUND OF THE INVENTION

1. Field of the Invention

The invention relates to a covering for an architectural opening, such as a roller shade for a window, having one or more, vertically-extending parallel layers of shade material. This invention especially relates to a roller shade, to which front and rear layers of a shade material are attached, so that the layers can be moved parallel to one another to open and close the shade to light.

2. Description of the Relevant Art

Architectural coverings are known with two vertically-extending parallel sheet layers, which are disposed one in front of the other and each of which has an array of elongated, longitudinally-extending, vertically-alternating transparent and opaque stripes. When the transparent stripes of one layer have been in vertical alignment with the transparent stripes of the other layer, light has been transmitted through the coverings, but when the opaque stripes of one layer have been vertically aligned with the transparent stripes of the other layer, these coverings have blocked light. See GB 926 663, GB 1 227 619, U.S. Pat. No. 2,029,675, FR 1 366 224, DE 2 326 438, NL 7209084 and U.S. Pat. No. 6,189,592.

The two vertically-extending layers of such coverings have been made of fabric, plastic or the like and have been connected at their top and/or bottom ends by top and/or bottom bars. A special fabric, very suitable for such coverings, has been described in EP 1 088 920 and EP 1 241 318. This fabric is a two layer woven fabric having one or more binder threads connecting the layers, so that one layer could slide along the binder threads and along the other layer.

Such double layer architectural coverings have been made as roller shades, having a roller to which the layers of shade materials have been attached at radially different locations of the roller, so that partial rotation of the roller has displaced the layers relative to each other and continued rotation has wound the layers about the roller. The layers of shade materials of roller shades have generally been attached to their rollers by folding each layer over an attachment member or rod and then sliding or pushing the attachment member with the layer folded over it into a groove or slit of the roller. See GB 19 449 and DE 25 19 365.

However, the use of an attachment member has proven unsatisfactory for attaching a layer of a shade material to a roller. If the shade material has not been well aligned with the roller when folded over its attachment member, the shade has not hung straight down from the roller and has not operated well. Also, the layer folded over the attachment member has sometimes tended to get out of alignment during assembly of the roller shade which has been hard to correct afterwards. With two layer roller shades, it has been particularly difficult to align the complementary patterns, typically stripes of the front and rear layers, using such attachment members. Also, the layers have tended to become skewed, relative to one another, when wound about the roller if both layers have not been perfectly aligned with the roller. When the layers have not been perfectly aligned, light has shone through gaps between the stripes, and the patterns have no longer appeared to be complimentary.

SUMMARY OF THE INVENTION

In accordance with this invention, an architectural covering, such as a roller shade, is provided which includes a vertically-extending layer of a shade material between an elongated longitudinally-extending roller and an elongated longitudinally-extending bar; an elongated groove extending longitudinally along the length of the outer surface of the roller; a top portion of the layer of shade material being attached to an elongated longitudinally-extending top attachment member in the groove; the layer of shade material extending longitudinally along the roller, so that partial rotation of the roller causes the layer to move vertically and continued rotation of the roller winds the layer around the roller, and wherein:

the outer surface of the top attachment member has at least two peaks along its length such that when the upper portion of the layer of the shade material is attached to the attachment member, the peaks extend through the upper portion of the layer, preferably through an open structured section of the top portion of the layer.

Advantageously, the shade material comprises a plurality of vertically-extending layers, especially front and rear layers, the outer surface of the roller comprises a plurality of radially spaced apart grooves, and a top portion of each layer is attached to a different attachment member in a different groove, especially front or rear groove. Also advantageously, a bottom portion of each layer of the shade material is also attached to an elongated longitudinally-extending bottom attachment member in an elongated longitudinally-extending slit in the bar; the outer surface of the bottom attachment member having at least two peaks along its length such that when the bottom portion of the layer of shade material is attached to the bottom attachment member, the peaks extend through the bottom portion of the layer, preferably through an open structured section of the bottom portion of the layer. It is particularly advantageous that the shade material comprises front and rear layers, each with an array of elongated, longitudinally-extending, vertically-alternating transparent and opaque stripes.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
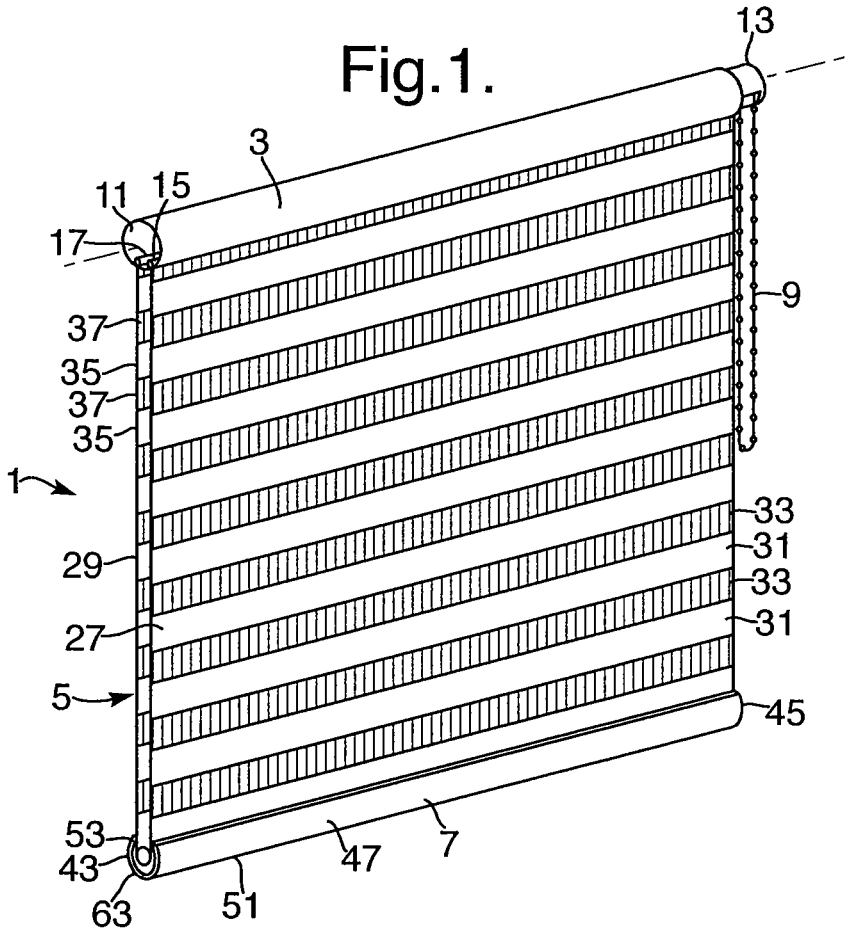
FIG. 1 is a schematic perspective view of a roller shade with a double layer shade material extending between an elongated roller and an elongated bottom bar.
Figure 2:
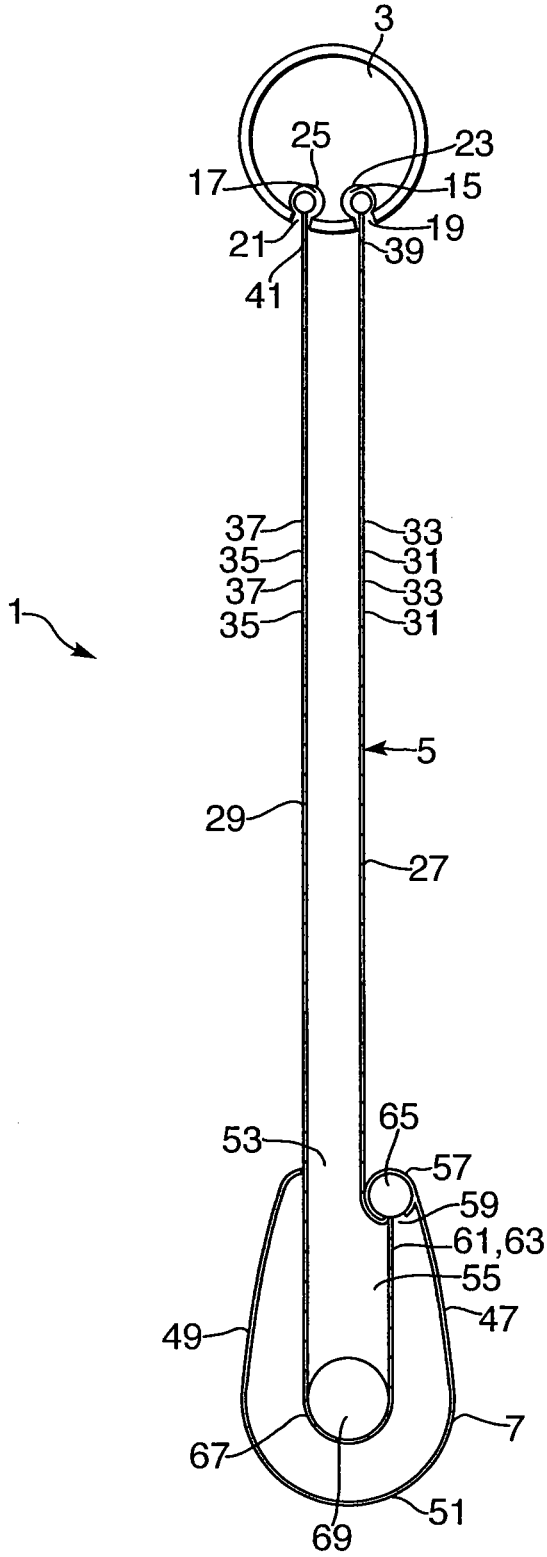
FIG. 2 is a cross-section of the shade of FIG. 1, showing the attachment of the shade material to the roller and bottom bar.

FIGS. 1 and 2 show a roller shade or blind 1 of the invention having an elongated longitudinally-extending roller 3 at its top, a two-layer vertically-extending shade material or covering 5, an elongated longitudinally-extending bar or rail 7 at its bottom and means 9 for rotating the roller 3 to raise and lower the shade material and the bar to open and close the shade (e.g., a conventional manually operated ball-chain or endless cord). The roller 3 is preferably a conventional hollow tube-like profile extending between a left end 11 and a right end 13. The outer surface 3A of the roller has and an elongated longitudinally-extending front groove 15 and an elongated longitudinally-extending rear groove 17. The front and rear grooves 15, 17 are radially spaced apart along the outer surface 3A of the roller and are preferably undercut grooves. In this regard, each groove 15, 17 has a longitudinally-extending top slit 19, 21 in communication with a laterally larger, interior top pocket 19A, 21A. The top pocket 19A, 21A of each groove 15, 17 can hold an elongate, longitudinally-extending top attachment member 23, 25, so that the top attachment members cannot fall out through the top slits 19, 21 while the shade material 5, attached to the top attachment members, extends downwards from the grooves.

The shade material 5 includes a vertically-extending front layer 27 and a vertically-extending rear layer 29. When the shade material 5 is assembled to the roller 3, the front layer 27 extends downwardly from the slit 19 of the front groove 15, and the rear layer 29 extends downwardly from the slit 21 of the rear groove 17. The front layer 27 has a plurality of elongate longitudinally-extending parallel rectangular stripes 31, 33. Relatively opaque stripes 31 alternate with relative translucent stripes 33. The rear layer 29 also has a plurality of elongate longitudinally-extending parallel rectangular stripes 35, 37 which are alternating relatively opaque stripes 35 and relatively translucent stripes 37. The rear layer 29 can be moved vertically relative to the front layer 27, so that the opaque stripes 31, 35 of both layers can be aligned with each other or with the translucent stripes 33, 37 of the opposite layer. Such movement of one layer relative to the other can be used to control and vary the light-transmitting properties of the shade 1.

The top portions 39, 41 of the front and rear layer 27, 29 of the shade material 5 are attached to the front and rear top grooves 15, 17 of the roller 3, using the front and rear, top attachment members 23, 25. The manner of attaching the layers to the top attachment members is described below in relation to FIGS. 3 and 4.

The bar 7 is preferably a generally U-shaped profile extending between a left end 43 and a right end 45. The bar (7) has a front wall 47, a rear wall 49 and a bottom wall 51 with an upwardly open, elongate, longitudinally-extending bottom slit 53 that opens into an interior space 55 in the bar. The bottom slit 53 extends along the entire length of the bar 7, and the shade material 5 is attached to the bar 7 and extends upwardly from the bottom slit 53 towards the roller 3. At the top of the front wall 47 of the bar 7 is an elongate longitudinally-extending interior undercut bottom pocket 57, adjacent the bottom slit 53. The bottom pocket 57 has a downwardly open, elongate, longitudinally-extending mouth 59 which is laterally smaller than the bottom pocket. Preferably, the bottom pocket 57 is integrally formed with the front wall 47 of the bar 7. The layers 27, 29 of the shade material 5, mounted on the bar 7, extend downwardly from the mouth 59 of the bottom pocket 57 into the interior space 55 of the bar and then upwardly through the bottom slit 53 towards the roller 3.

As best shown in FIG. 2, the top portion 39 of the front layer 27 of the shade material 5 is held by the front top attachment member 23 in the top pocket 19A of the front top groove 15 of the roller 3, and the top portion 41 of the rear layer 29 of the shade material is held by the rear top attachment member 25 in the top pocket 21A of the rear top groove 17 of the roller. Also, front and rear bottom portions 61, 63 of the front and rear layers 27, 29 of the shade material 5 are attached to a bottom attachment member 65 in the bottom pocket 57 in the bar 7. Preferably, the rear layer 29 of the shade material is longer than the front layer 27, and when the bottom portions 61, 63 of the two layers are mounted in the bottom pocket 57, a loop 67 is formed in the rear layer 29 in the interior space 55 of the bar to serve as a hammock for a ballast rod 69. The ballast rod 69 serves to pull the shade material taut and to help keep its layers aligned during operation of the shade 1.

The top and bottom attachment members 21, 23, 65 with the shade material 5 attached to them are preferably slid into the top and bottom pockets pockets 19A, 21A, 57 from the right or left ends 11, 13, 43, 45 of the roller 3 and bar 7. The left and right ends of the roller and bar can then be closed by a suitable end cap (not shown).

Partial clockwise rotation of the roller 3, as shown in FIG. 2, by the operating means 9, will move the front and rear layers 27, 29 relative to each other, for example, to align either the opaque stripes of both layers, or the opaque stripes of each layer with the translucent stripes of the opposite layer. The front and rear top grooves 15, 17 will move clockwise, and the rear layer 29 will be lifted a small distance, causing the loop 67 in the rear layer to move upwards within interior space 55 of bar 7 with ballast rod 69. The small distance can be the vertical height of a stripe 35, 37 of the rear layer 29, thereby causing the opaque stripes 31, 35 of both layers 27, 29 to align or the opaque stripes 35 of the rear layer 29 to align with the translucent stripes 33 of the front layer. Continued clockwise rotation of the roller 3 will further lift the loop 67 and ballast rod 69 into abutment with the front and rear walls 47, 49 of the bar 7, near the bottom slit 53. If such clockwise rotation is continued, the front and rear layers 27, 29 of the shade material 5 will be wound about the roller 3, thereby lifting the bar 7 upwardly. Thereafter, counter clock wise rotation will move the front and rear top grooves counter clockwise, causing the shade material to be unwound and the bar to be lowered. When the shade material is unwound and the counter clockwise rotation continues, the rear layer 29 will move again relative to the front layer 27. Continued counter clockwise rotation after the ballast rod 69 has reached its lowest point will again cause the shade material to be wound around the roller and the bar to be lifted.

The depth of the interior space 55 of the bar 7 is preferably at least twice the height of a stripe 31, 33, 35, 37 of the shade material 5. This ensures that there is enough space for the rear layer 29 to move relative to the front layer 27 between the closed position of the shade 1 when the opaque stripes 31, 35 of one layer are aligned with the translucent stripes 33, 37 of the opposite layer and the open position of the shade when the opaque stripes of both layers are aligned.

Figure 3A:
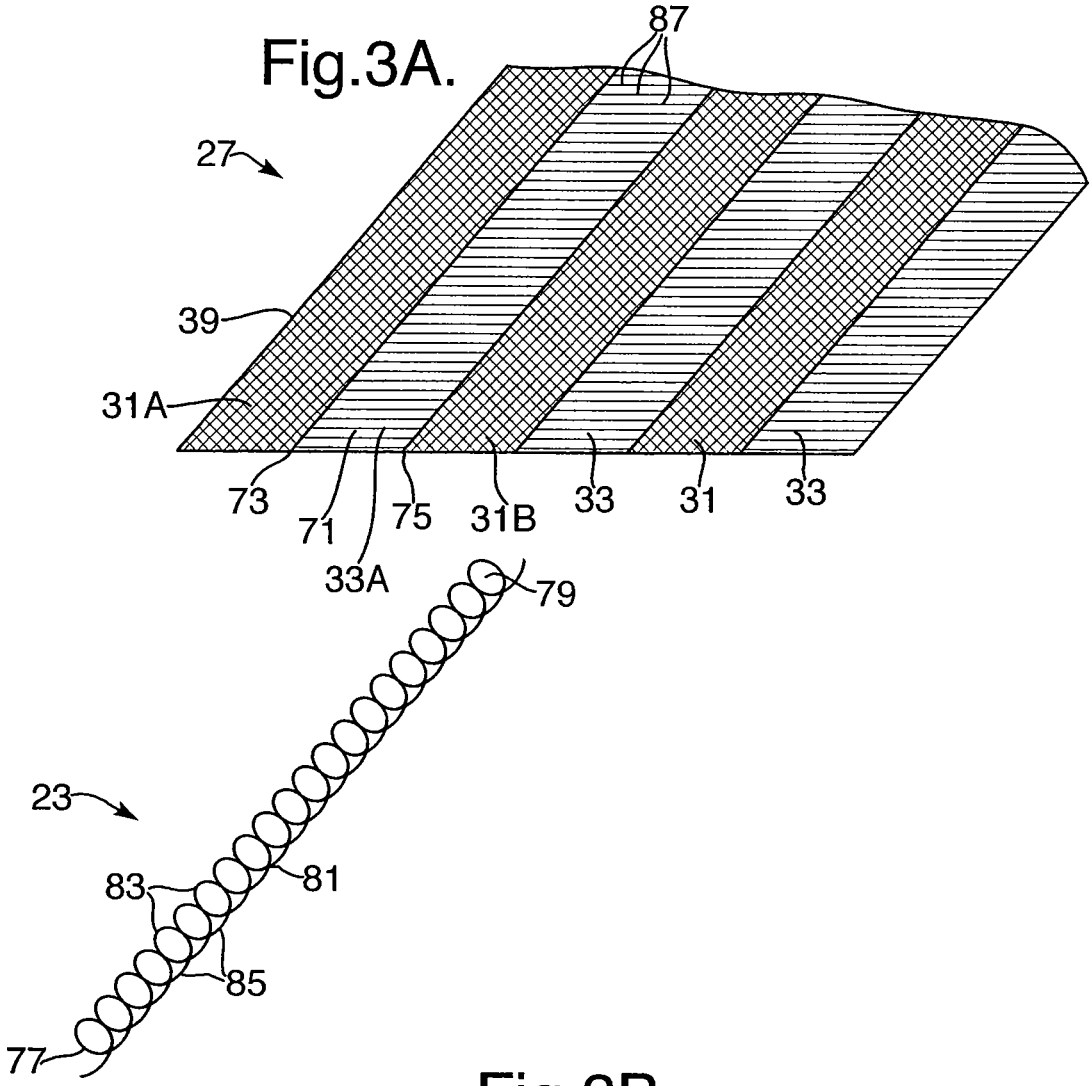
FIG. 3A-3D is a schematic representation of the attachment of a first embodiment of an elongated attachment member to one of the layers of a woven fabric shade material and the subsequent attachment of the attachment member to an elongated groove in the roller.

FIGS. 3A-3D show the assembly of the top portion 39, 41 of either the front or rear layer 27, 29 of a woven shade material 5 to the front or rear, top attachment member 23, 25 and then to the front or rear top groove 15, 17 of the roller 3. The assembly will be explained using the front layer 27 and the front top attachment member 23 as an example, but it is identical for the rear layer 29. In FIG. 3A the front layer 27 and front top attachment member are ready to be assembled, in FIG. 3B they are in a first stage of assembly, in FIG. 3C they are completely assembled and ready for insertion into the front to groove 15, and in FIG. 3D the front top attachment member 23 with the front layer 27 are in the front top groove 15.

Figure 3B:
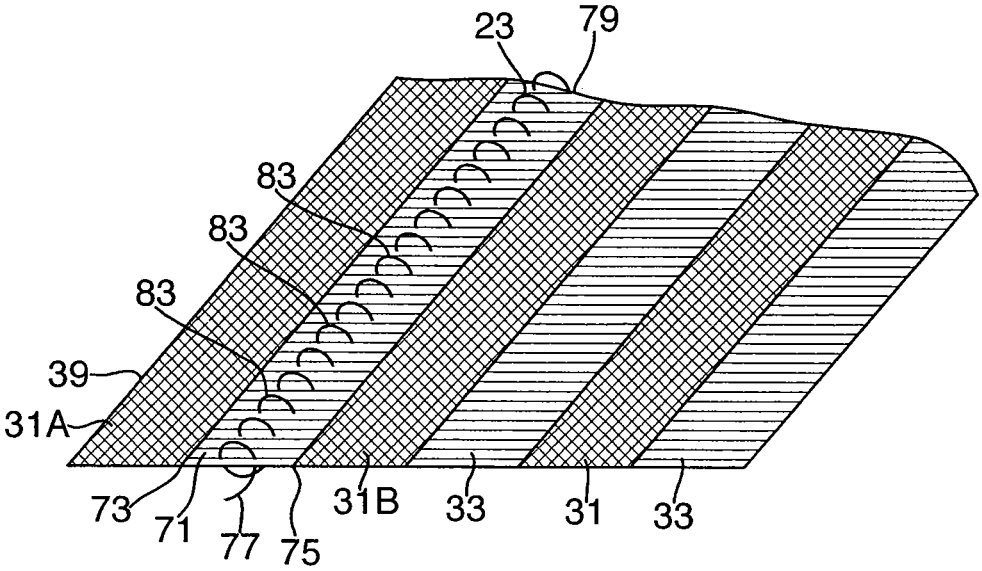
Figure 3C:
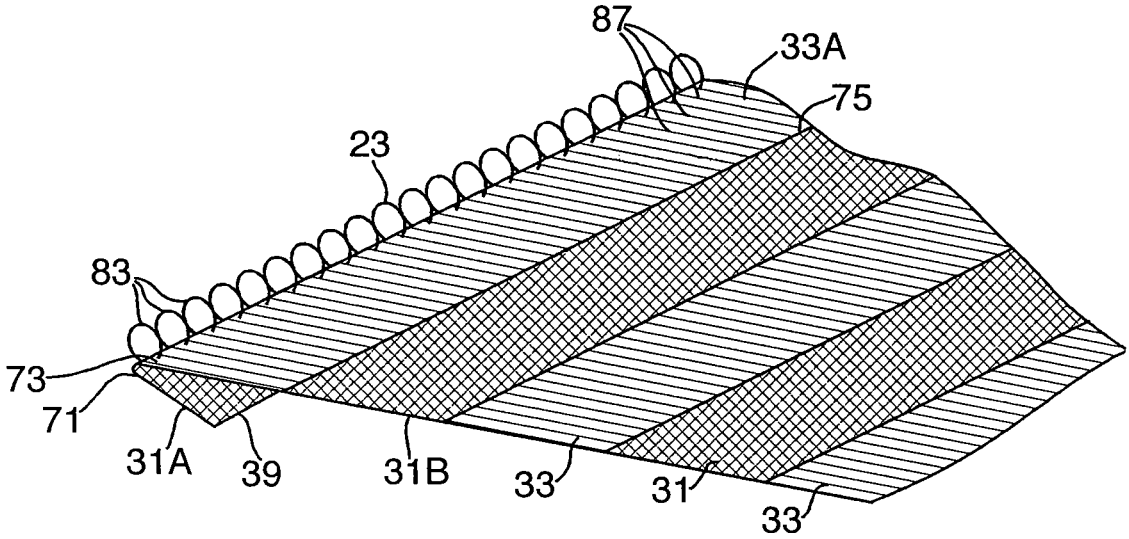
Figure 3D:
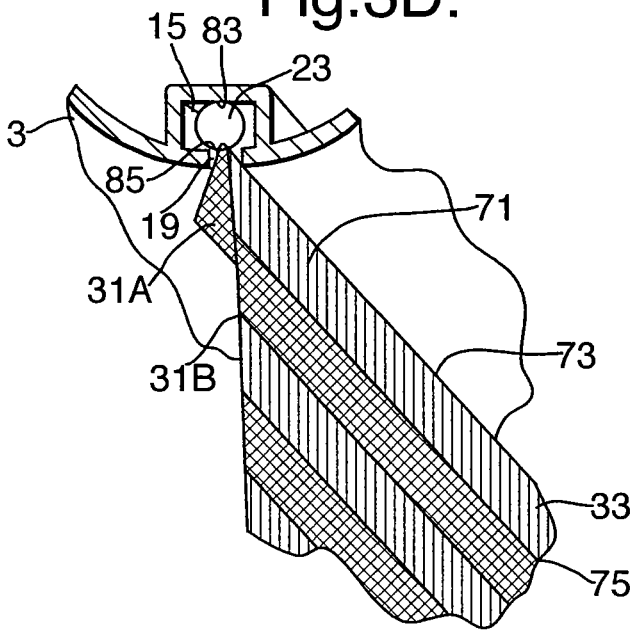

As shown in FIG. 3A, it is preferred that the top-most translucent stripe 33A in the top portion 39 of the front layer 27 is an open-structured stripe 71 which includes top and bottom, continuous, longitudinally-extending border lines 73, 75 along neighboring top and bottom opaque stripes 31A, 31B with the border lines being perpendicular to open slots in the open structured stripe 71. The top attachment member 23 has a left end 77, a right end 79 and main body 81 in between. The main body 81 includes a plurality of alternating generally outwardly- or upwardly-extending peaks or protuberances 83 and generally inwardly- or downwardly-extending valleys or depressions 85 along its length. When the open-structured stripe 71 of the front layer 27 is lowered onto the top attachment member 23, the peaks 83 extend through the open-structure of the stripe 71 and outwardly of the front layer. This is shown in FIG. 3B. The front layer is then folded around the top attachment member to keep the peaks 83 extending through, and outwardly away, from the front layer. This is shown in FIG. 3C. Thereby, the attachment member 23 can move within the slot of the open structured stripe 71 and abut against the top border line 73 of the open-structured stripe 71, adjacent to the top opaque stripe 31A. Since the top attachment member 23 abuts against the top opaque stripe 31A, there is an automatic horizontal alignment of the front layer 27. If necessary, the top border line 73 can be pulled into abutment with the top attachment member after the front layer 27, with front top attachment member 23 is inserted into the front groove 15 of the roller 3 as shown in FIG. 3D. Once the shade 1 is completely assembled and ballast rod 69 is inserted in hammock-like loop 67 of the rear layer 29 as shown in FIG. 2, the weight of the ballast rod will ensure alignment of the front and rear layers.

Figure 4A:
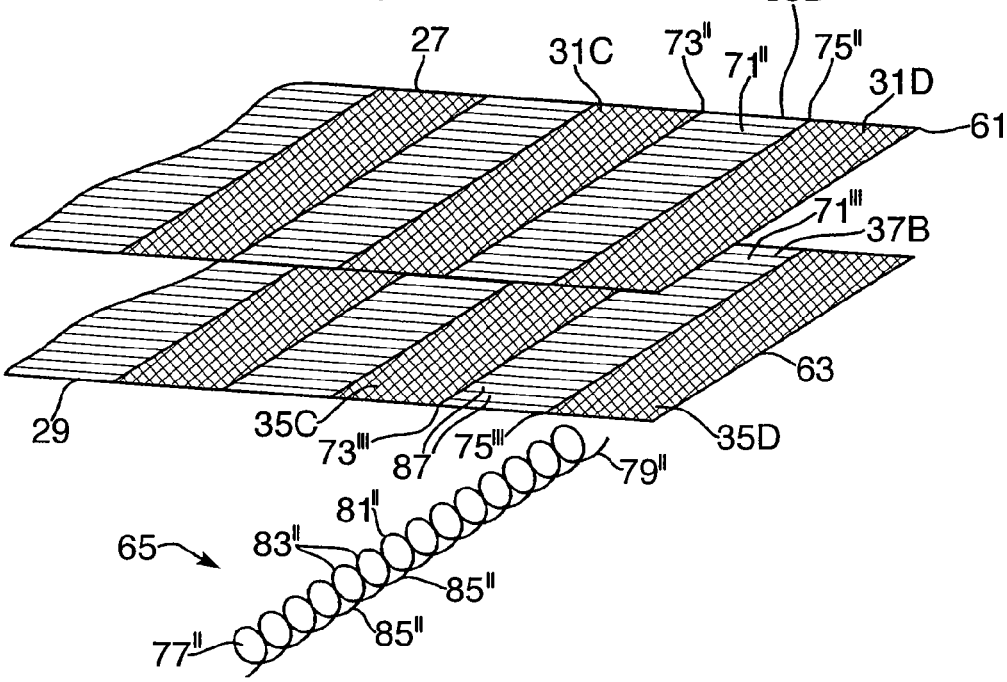
FIGS. 4A-4C is a schematic representation of the attachment of two layers of the woven fabric shade material together to the first embodiment of the attachment member prior to attaching the attachment member to the bottom bar.
Figure 4B:
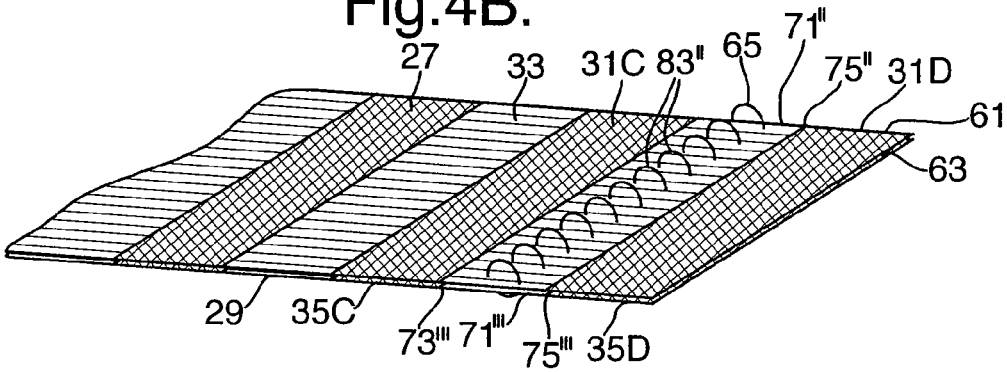
Figure 4C:
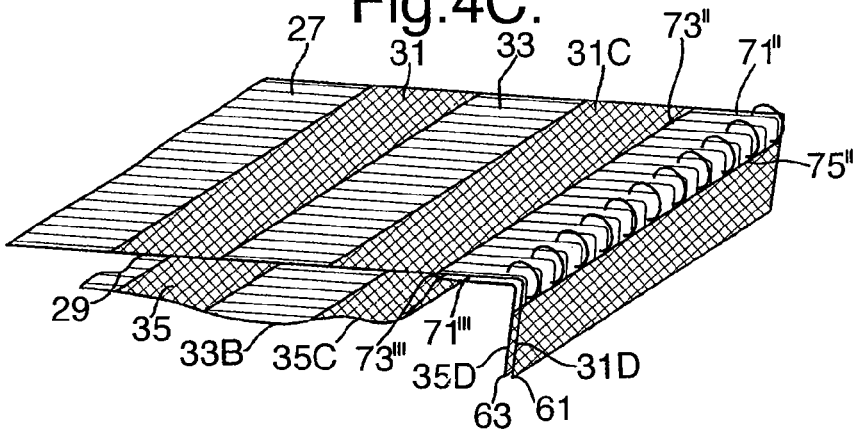

FIG. 4A-4C show the attachment of the front and rear layers 27, 29 of the shade material 5 to the bottom attachment member 65. The bottom attachment member 65 is preferably identical to the front and rear top attachment members 23, 25. Preferably, the bottom-most translucent stripes 33B, 37B of the bottom sections 61, 63 of the front and rear layers 27 and 29 are open-structured stripes 71" and 71'", respectively. As described above, each open structured stripe 71", 71'" includes top and bottom, continuous, longitudinally-extending border lines 73", 75" and 73'", 75'" along neighboring top and bottom opaque stripes 31C, 31D and 35C, 35D of the front and rear layers. The bottom attachment member 65 has a left end 77", a right end 79" and a main body 81". The main body 81" includes a plurality of alternating generally upwardly-extending peaks 83" and downwardly-extending valleys 85" along its length. Preferably, the bottom open-structured stripes 71", 71'" of the front and rear layers 27, 29 are aligned one on top of the other when they are lowered onto the bottom attachment member 65. The peaks 83" of the bottom attachment member 65 will then extend through the open-structured stripes 71", 71'" of both layers. This is shown in FIG. 4B. The two layers can then be folded around the bottom attachment member 65 to keep the peaks 83" of the bottom attachment member extending outwardly of the layers and extending away from the front layer 27 as shown in FIG. 4C. The attachment member then abuts against the bottom closed border lines 75", 75'" of the open structured stripes 71" and 71'".

The attachment members 23, 25, 65 are preferably in the shape of helically wound wires, such as helical springs (e.g., steel springs). Such helical windings can provide the needed peaks and valleys to the attachment members. However, other forms of attachment member can be used, so long as they have a plurality of alternating peaks and valleys along the length of the attachment member.

FIG. 5 shows five alternative embodiments 123, 223, 323, 423, 523 of attachment members which are similar to the attachment member 23 of FIGS. 3 and 4 and for which corresponding reference numerals (greater by 100, 200 or 300) are used below for describing the same parts or corresponding parts.

Figure 5A:
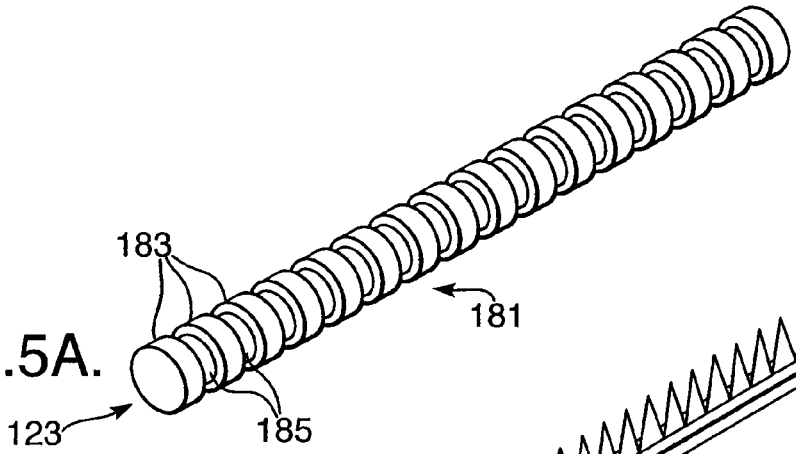
FIGS. 5A-5E are schematic perspective views of alternative embodiments of the attachment members.
Figure 5B:
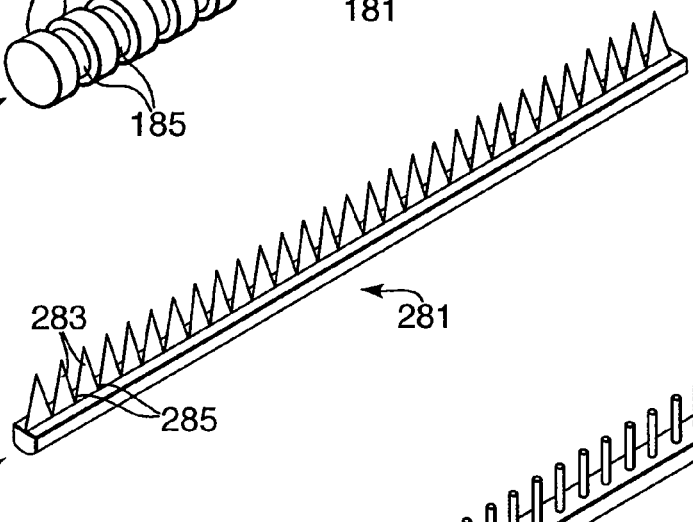
Figure 5C:
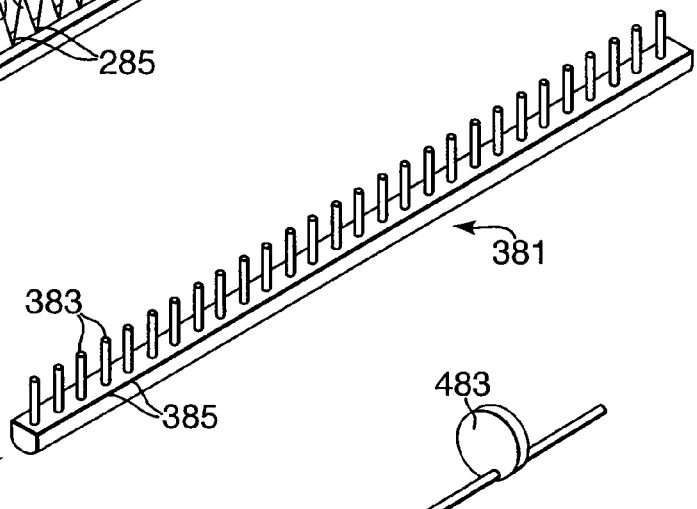
Figure 5D:
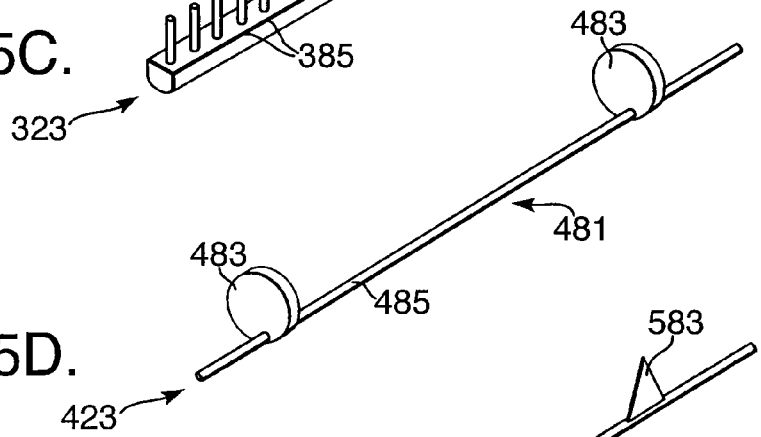
Figure 5E:
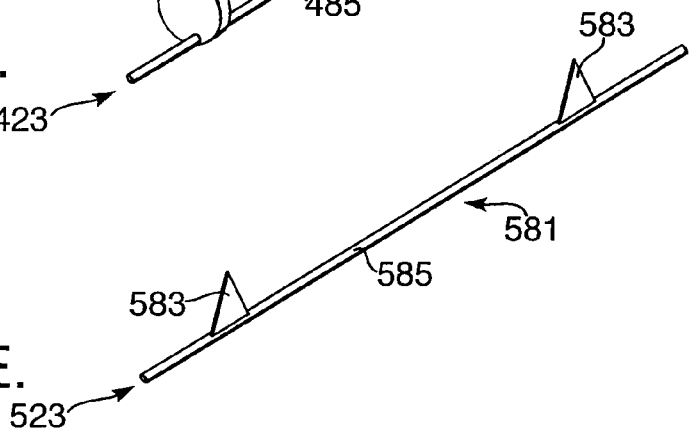

In FIG. 5A, an attachment member 123 is an elongated rod-like structure 181, along the axis of which, wheel-like portions or peaks 183 of greater radius alternate with wheel-like portions or valleys 185 of smaller radius. In FIGS. 5B and 5C, comb-like attachment members 223, 323 each have an elongated body 281, 381 with teeth or peaks 283, 383 alternating with openings or valleys 285, 385. In FIGS. 5D and 5E, comb-like attachment members 423, 523 each have an elongated body 481, 581 with a pair of teeth or peaks 483, 583 alternating with openings or valleys 485, 585. In FIG. 5D, each peak 483 is a substantially round disk, and in FIG. 5E, each peak 583 is wedge-shaped.

The top and bottom open-structured stripes 71, 71" and 71'" of the front and rear layers 27, 29 of the sheet material 5 can be any type of open-structured material. It is preferred that each stripe 71, 71" and 71'" includes a plurality of vertically-extending bridging members 87 between its top and bottom border lines 73, 73", 73'", 75, 75", 75'". These bridging members 87 are preferably distributed along the longitudinal length of each open-structured stripe. The bridging members can be formed by cutting away material from the front and rear layers 27, 29 in their top-most and bottom-most translucent stripes. When the front and rear layers are assembled with the attachment members 23, 25, 65, 123, 223, 323, 423, 523 each peak 83, 183, 283, 383, 483, 583 of an attachment member extends through an open-structured stripe 71, 71", 71'" between, and outwardly of, a pair of adjacent bridging members 87 of the layers. Preferably, the double-layer fabric shade material 5 is woven with its open-structured stripes being formed by omitting warp or weft threads of the fabric, thereby forming the bridging members 87 as weft or warp threads.

It is not necessary that the number of peaks 83, 183, 283, 383, 483, 583 on the attachment members 23, 25, 65, 123, 223, 383, 483, 583 and the number of bridging members 87 in the open-structured stripes 71, 71" and 71'" are equal. For a minimal alignment of the shade material 5 with the roller 3, only about two peaks on each attachment member are needed. See FIGS. 5D and 5E. The longitudinal spacing between adjacent bridging members 87 is not considered critical, so long as at least two peaks extend between adjacent pairs of bridging members.

FIG. 6 shows an alternative embodiment of a layer 627 of a two-layer shade material 605 of the invention which is similar to the front layer 27 of the shade material 5 FIGS. 3 and 4 and for which corresponding reference numerals (greater by 600) are used below for describing the same parts or corresponding parts.

Figure 6A:
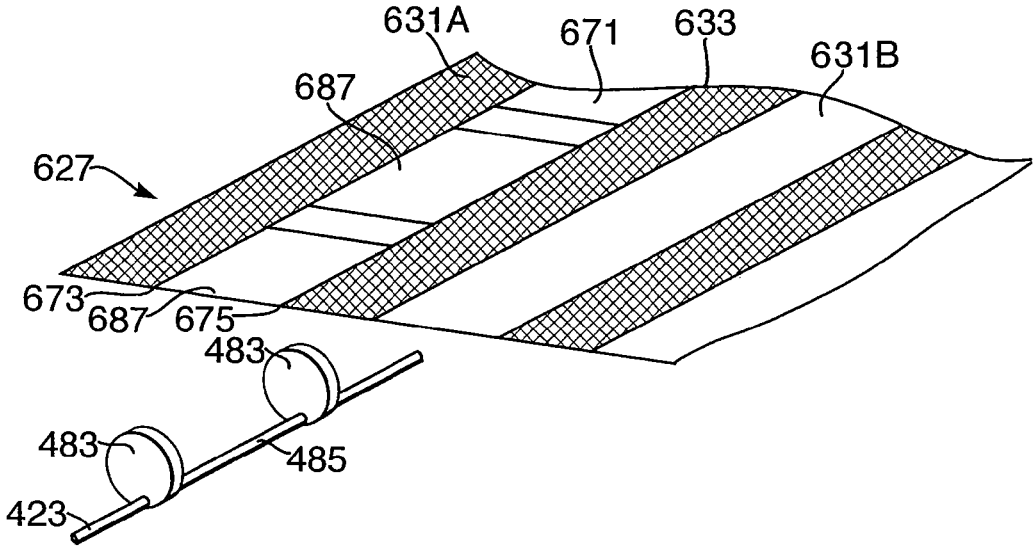
FIGS. 6A-6C are schematic perspective views, like FIGS. 3A-3C, of the attachment of the attachment member of FIG. 5D to a non-woven shade material.
Figure 6B:
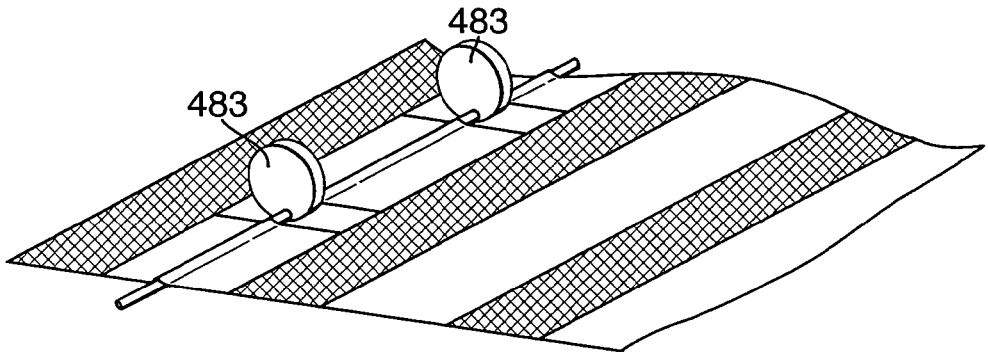
Figure 6C:
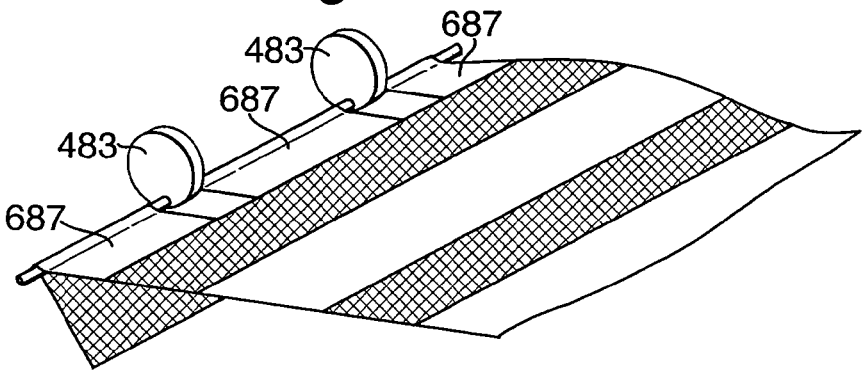

Shown in FIGS. 6A-6C, the layer 627 of the two-layer shade material 605 is a non-woven material. Which can be a non-woven fabric but can also be a plastic sheet material or the like. A plurality of longitudinally-adjacent open-structured stripes 671 are cut into the top-most translucent stripe 633A in the top portion 639 of the layer 627 and bridging members 687 are left between the open-structured stripes 671. Each open-structured stripe 671 includes top and bottom, closed longitudinally-extending border lines 673, 675 along neighboring top and bottom opaque stripes 631A, 631B. FIG. 6A shows the layer 627 and a front attachment member 423 of FIG. 5D prior to being assembled. FIG. 6B shows the layer 627 positioned over the front attachment member 423 with its peaks 483 directly underneath the open-structured stripes 671 of the layer. FIG. 6C shows the peaks 483 of the front attachment member 423 inserted into the open-structured stripes 671 of the layer 627, between its bridging members 687 and the layer then folded around the attachment member, with the peaks 483 outside of, and extending away from the layer, so that the attachment member can then be inserted into the front groove 15 of the roller 3 of the shade 1.

In FIG. 6, the bridging member 687 are shown as relatively wide, and the spacings between them are relatively narrow. However, this is not necessary. Likewise, the attachment member 423 is shown with two peaks 483, but it could have more peaks.

This invention is, of course, not limited to the above-described embodiments which may be modified without departing from the scope of the invention or sacrificing all of its advantages. In this regard, the terms in the foregoing description and the following claims, such as "longitudinal", "vertical", "horizontal", "top", "bottom", "radial", "clockwise", "counter-clockwise", "right" and "left", have been used only as relative terms to describe the relationships of the various elements of this invention for architectural coverings.

For example, the layers of the shade material 5 of the roller shade 1 can be fabric, preferably a woven or knit fabric (as shown in FIGS. 3 and 4), or a non-woven fabric or perforated plastic sheet (as shown in FIG. 6). However, with a non-woven fabric, separate border lines 673, 675 are preferably provided, for example by providing a line of adhesive or an adhesively attached reinforcing strip along the top and bottom borders of the open-structured stripes 671.

Moreover, the roller 3 can be at the bottom of the shade 1 and the bar 7 can be at the top of the shade.

I claim:

1. An architectural covering, comprising:

a vertically-extending layer of a shade material between an elongate longitudinally-extending roller and an elongate longitudinally-extending bar;

an elongate slit extending longitudinally along the length of the outer surface of the roller, the elongate slit communicating with an elongate groove formed within an interior of the roller;

a top portion of the layer of shade material extending from the elongate groove in the interior of the roller through the elongate slit to the outer surface of the roller;

the layer of shade material extending longitudinally along the roller, so that partial rotation of the roller causes the layer to move vertically and continued rotation of the roller winds the layer around the roller;

an elongate longitudinally-extending top attachment member having at least two peaks along its length and being positioned in the elongate groove;

wherein said vertically extending layer of shade material includes a substantially opaque horizontal stripe and immediately adjacent there beneath a horizontal open structured section having vertically extending open slots and a border defined between said opaque stripe and said open structured section, said attachment member being positioned within said groove such that said peaks are confined within said groove and said border is parallel with the roller, wherein when said top attachment member is positioned within said groove, said peaks extend through said slots in said open structured section of the layer of shade material such that the layer of shade material is slidably movable relative to, and hangs from, said top attachment member.

2. The covering of claim 1 further including a substantially opaque horizontally extending lower stripe of material along the bottom of said shade material and an adjacent contiguous section of open structured material immediately above the lower stripe of substantially opaque material defining a border between said opaque stripe and said open structured material, said open structured material including vertically extending open slots, and an elongate longitudinally extending slit in the bar; a bottom attachment member having at least two peaks along its length such that when the bottom of the layer of shade material is attached to the bottom attachment member, the peaks extend through the slots in the open structured section of material at the bottom of the shade material and move into abutment with said border between the open structured section at the bottom of the shade material and the substantially opaque section at the bottom of the shade material to align the border at the bottom of the shade material in parallel relationship with the bar.

3. The covering of claim 1, wherein the top attachment member includes at least one helically wound wires.

4. The covering of claim 1, wherein the peaks of the top attachment member are wholly confined within the elongated groove when inserted through said slots in said open structured section.

5. The covering of claim 1, wherein said top attachment member is a helical spring.

6. The covering of claim 5, wherein said helical spring is a steel spring.

7. The covering of claim 1, wherein said peaks are wedge-shaped.

8. The covering of claim 1, wherein said peaks are substantially round disks.

9. The covering of claim 1, wherein said peaks are elongate teeth.

10. A method of attaching an elongated shade material to an elongated bar in an architectural covering so the length of the shade material is perpendicular to the length of the bar comprising the steps of:

providing an elongated bar with an elongate slit in an external surface thereof, the elongate slit communicating with an elongate groove formed within an interior of the bar, providing a layer of shade material for attachment to said bar, said shade material including a first stripe perpendicular to the length of said shade material and a second stripe parallel to the first stripe defining a border between the first and second stripes which is perpendicular to the length of said shade material, said second stripe being open structured so as to define open slots parallel with the length of the shade material, providing an elongated attachment member having at least two peaks along its length, extending said peaks through said slots in said second stripe, positioning said attachment member with said second stripe of material thereon in said elongate groove in a manner to at least releasably retain said attachment member in said groove with said border parallel with said bar so that the layer of shade material hangs from said peaks and extends from the elongate groove in the interior of the bar through the elongate slit to the external surface of the bar, and after positioning said attachment member in said groove, slidably moving said shade material relative to said attachment member.

11. The covering of claim 10, wherein said attachment member is a helical spring.

12. The covering of claim 11, wherein said helical spring is a steel spring.

13. The covering of claim 10, wherein said peaks are wedge-shaped.

14. The covering of claim 10, wherein said peaks are substantially round disks.

15. The covering of claim 10, wherein said peaks are elongate teeth.

* * * * *